United States Patent [19]

Keller

[11] 4,137,739

[45] Feb. 6, 1979

[54] LOCK CYLINDER FOR A SAFETY LOCK

[76] Inventor: Ernst Keller, Querstrasse 6, 8805 Richterswil, Switzerland

[21] Appl. No.: 829,182

[22] Filed: Aug. 30, 1977

[51] Int. Cl.[2] ..... E05B 27/06

[52] U.S. Cl. ..... 70/358; 70/364 A; 70/419

[58] Field of Search ..... 70/35 B, 364 A, 373, 70/374, 375, 378, 419

[56] References Cited

U.S. PATENT DOCUMENTS

| | | | |
|---|---|---|---|
| 3,492,842 | 2/1970 | Schlage | 70/375 |
| 3,494,158 | 2/1970 | Bauer | 70/378 |
| 3,974,671 | 8/1976 | Rossetti | 70/375 |

*Primary Examiner*—Robert L. Wolfe
*Attorney, Agent, or Firm*—Browdy and Neimark

[57] ABSTRACT

A cylinder for a safety lock with a cylinder housing and a cylinder plug has tumblers made in the form of plug pins and housing pins. The tumblers are aligned by a key inserted into the lock. Each row of the housing pins is mounted with an associated pin spring in a respective separate chamber, the chambers being installed in respective recesses in the cylinder housing. The separate chambers are made in the form of sliders insertable in the axial direction in longitudinal channels in the cylinder housing, housing pins with their spring being guided in bores. The sliders are mounted so that they have axial play in the longitudinal channels.

9 Claims, 6 Drawing Figures

LOCK CYLINDER FOR A SAFETY LOCK

BACKGROUND OF THE INVENTION

This invention relates to a lock cylinder for a safety lock with a cylinder housing and a cylinder plug. The invention relates more particularly to such a lock cylinder provided with tumblers in the form of plug pins and housing pins, the tumblers being aligned by a key inserted into the lock. Each row of housing pins is mounted with its pin springs in a separate chamber, the chamber being mounted in turn in a recess in the cylinder housing.

In cylinder locks with lock cylinders of conventional design, the cylinder housing and cylinder plug are provided with drilled guide channels for the pin tumblers. In order for the individual housing and plug pins to cooperate smoothly, such safety cylinders must be manufactured with great precision and consequently are expensive.

It is also known from German Pat. No. 551,304 to arrange the housing pins with their associated springs in a separate chamber, the chamber being mounted in turn during assembly in a recess in the cylinder housing, the chamber being inserted in the bore of the cylinder housing and then pressed radially outward into the corresponding recess. However, this design likewise requires high precision and is costly.

In order to make the manufacture of lock cylinders more efficient, attempts have also been made to make the cylinder housing and cylinder plug in the form of a number of parts, e.g. to divide them longitudinally, so that the parts can be manufactured by stamping or casting methods. However, experience has shown that it is nearly impossible to satisfy the requirements relating to safety when the lock cylinders have been assembled, since the tolerance of the individual parts results in excessive variations from the desired parameters during assembly. These are manifested by jamming of the cylinder plug and excessive resistance to the insertion and withdrawal of the key.

SUMMARY OF THE INVENTION

It is the principal object of the present invention to provide a lock cylinder of the type described hereinabove such that, on the one hand, considerable manufacturing tolerances, which is advantageous from the manufacturing technology standpoint are achieved and which, at the same time, offers a maximum of safety and ease of operation.

The foregoing object, as well as others which are to become clear from the text below, is achieved according to the invention by virtue of the fact that the separate chambers are made in the form of sliders which can slide in the axial direction in the lengthwise channels of the cylinder housing, with the housing pins and their operatively associated springs being guided in bores in the sliders, and by the fact that these sliders are mounted in the lengthwise channels in such a fashion that they have axial play.

This ensures that with an axial play of approximately 0.2 to 0.3 mm for the sliders, the sliders are centered by the plug pins being pushed out as the key is inserted.

The cylinder plug can then be turned very easily without holding it.

An advantageous embodiment of the invention provides that at least one plug pin and housing pin pair is provided at the ends which come in contact with one another with a projection in the shape of a cone or sphere and/or a corresponding depression, the projection and depression meshing with one another when the cylinder plug is in a locked position and an open position. In this manner, the centering, i.e., aligning effect of the plug pins on the sliders is considerably improved, in comparision with the prior art. This also has the advantage that the position in which the key may be withdrawn is clearly perceptible as a result of the meshing of the conical projections in the corresponding depressions.

Thus, in order for a plurality of rows or a single row of housing pins to be installed optionally in a cylinder housing with a plurality of lengthwise channels, it is advantageous if one or more of the lengthwise channels are blocked by inserts free of bores. The same cylinder housing can then be used, without reworking, for different types of locks, a distinct advantage.

In order to eliminate radial play of the cylinder plug in the cylinder housing it is advantageous for the sliders to be pressed against the cylinder plug by force-providing spring means, e.g., bent leaf springs.

An additional embodiment of the invention provides that the plug pins are also disposed in separate sliders in the cylinder plug.

This has the considerable advantage that only the sliders need be replaced to change the core patterns for the pin tumblers. The cylinder housing and the cylinder plug can remain unchanged and consequently may be kept in stock as finished products. The various bore patterns can be provided in the interchangeable sliders, which results in definite economic advantages.

Another desirable effect of the present invention resides in the fact that the relatively small sliders, in contrast to the cylinder housings and cylinder plugs into which the bores are mounted directly, can be readily hardened. This makes it impossible for anauthorized persons to drill out the lock.

BRIEF DESCRIPTION OF THE DRAWINGS

The drawings show embodiments of the subject of the invention.

DETAILED DESCRIPTION OF THE PREFERRED EMBODIMENTS

Figure 1:
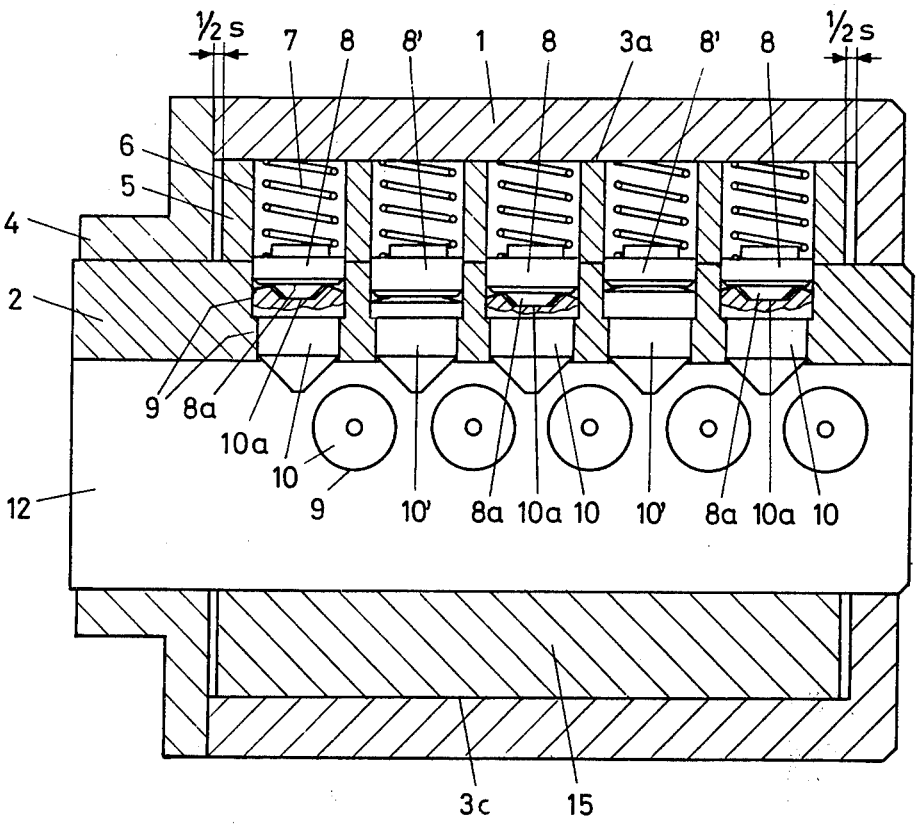
FIG. 1 is a view, in longitudinal section, of a first exemplary embodiment of a lock cylinder constructed according to the present invention, without the key.
Figure 2:
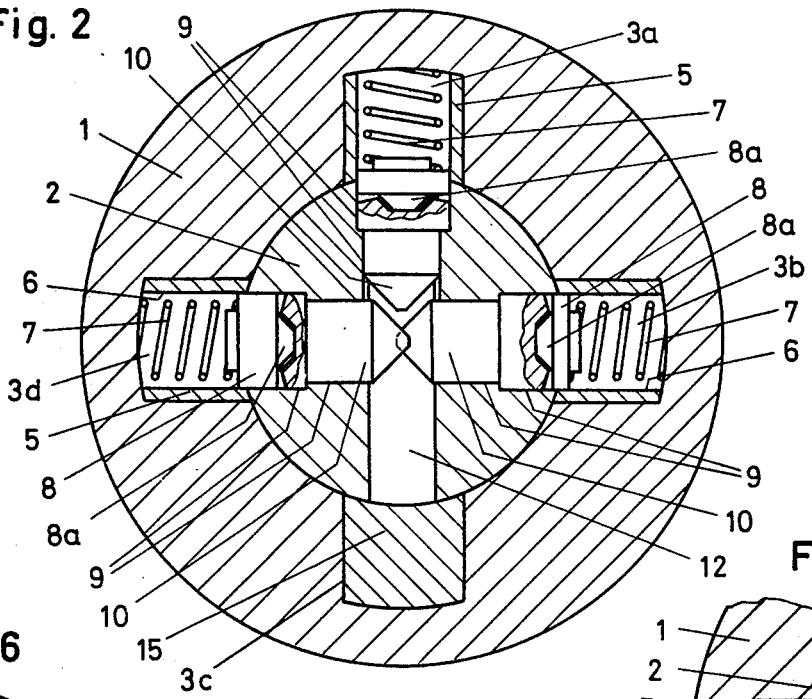
FIG. 2 is a cross section through the lock cylinder of FIG. 1.

FIGS. 1 and 2 show a lock cylinder with a cylinder housing 1 and a cylinder plug 2. The cylinder housing 1 is provided with four longitudinal channels 3*a*, 3*b*, 3*c* and 3*d*. These longitudinal channels are open at the end of the cylinder housing 1, which is at the left in FIG. 1 and/or may be closed subsequently by a sleeve 4 installed over the plug 2. The longitudinal channels terminate a short distance from the right-hand end of cylinder housing 1.

Sliders 5 having respective bores 6 are inserted in the longitudinal channels 3*a*, 3*b* and 3*d*. Pin springs 7 and respective housing pins 8 are disposed in the bores 6. The sliders 5 are axially slidable in the longitudinal channels 3*a*, 3*b*, and 3*d* and are inserted so as to provide a play s of approximately 0.2 to 0.3 mm. In FIG. 1, slider 5 is shown centered exactly, so that it has a play of ½ s to either side in the cylinder housing.

Plug pins 10 are inserted in the cylinder plug 2 in respective spaced bores 9 in known fasion, these pins being tapered conically toward the inside. The conical tips of the pins 10 cooperate in known fashion with bores sunk in a key 11 (FIGS. 3, 4).

Of the five plug pins visible in FIG. 1, two pins 10' are made in conventional fashion. The surfaces of these plug pins 10' and corresponding housing pins 8' which come in contact with each other are made slightly convex.

Figure 3:
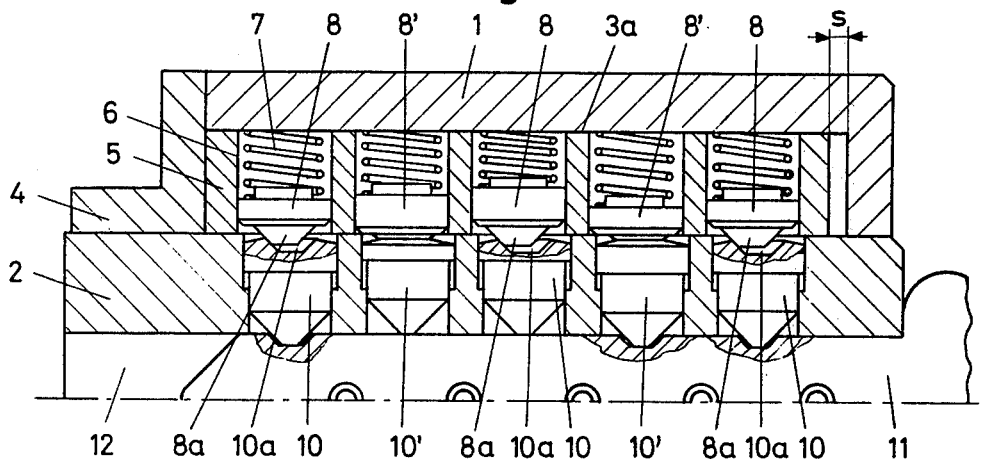
FIG. 3 is a longitudinal section through one half of a lock cylinder of FIG. 1, showing the key inserted.
Figure 4:
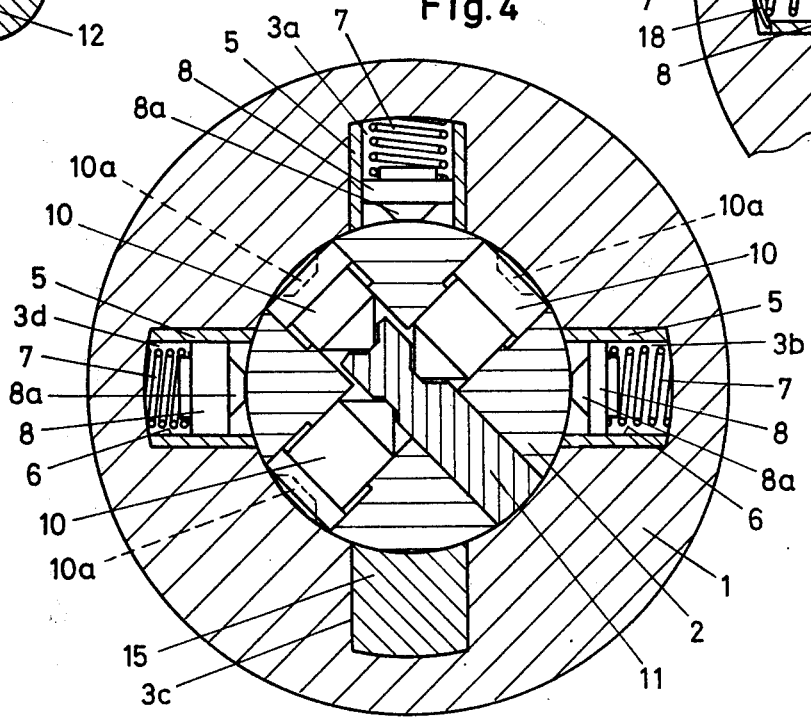
FIG. 4 is a cross section through a lock cylinder shown in FIG. 3, with the key turned 45°.

In contrast to this arrangement, the three housing pins 8 are each provided with a respective frustroconical projection 8*a* at their ends (see FIGS. 3, 4). The plug pins 10 which cooperate with the housing pins 8 are provided with a corresponding frustroconical depression 10*a* (see FIG. 3). The interaction between the projections 8*a* and cooperating depressions 10*a* has a centering effect upon the resulting pin pair and consequently upon the slider 5 as well. The projection and depression could also have different shapes; for example, the projection and depression could be conicalor a section of a sphere or cone; the only important feature is that when the ends of the pin pair mesh, a centering effect is produced and that when the cylinder plug 2 is rotated, the respective meshing projection 8*a* and the depression 10*a* are pushed apart. The taper angle of the projections 8*a* and/or the depressions 10*a* must therefore be sufficiently large that no self-locking effect is produced.

FIGS. 1 and 2 show the lock cylinder in the locked position. Insertion of a key 11 (FIGS. 3, 4) unlocks the plug 2 in known fashion. When the key 11 is inserted, the slider 5 is displaced against the inside of the lock, so that only full play s is available at the outside of cylinder housing 1. However, as FIG. 3 illustrates, the cylinder plug 2 can be turned easily by the key 11. When the key 11 is withdrawn, the slider 5 is displaced rightward with the above-mentioned play s. However, as soon as the key 11 is completely withdrawn from the lock 12, the pin pair provided with the projections 8*a* and the depressions 10*a* is again centered, whereby the slider 5 is displaced into the position shown in FIG. 1, in which the housing pins 8, 8' can mesh with the bores 9 of the plug pins 10. The slider 5 is consequently automatically aligned with the position of the bores 9 in the cylidrical plug 2, whereby any manufacturing tolerances which may be present in effect cancelled out.

Figure 5:
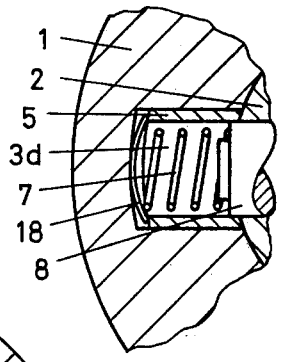
FIG. 5 is a view, in partial cross section through a second embodiment of a lock cylinder according to the present invention.

FIG. 5 is a partial sectional view of a second embodiment of a lock cylinder according to the present invention in which a leaf spring 13, convex in cross section, is disposed between the outside of the slider 5 and the bottom of the longitudinal channel 3*d*. This spring 13 presses the slider 5 radially against the cylindrical plug 2 thereby eliminating any radial play which may be present. It would also be possible to press the slider 5 against the cylinder plug 2 by other types of springs, e.g., coil springs.

Figure 6:
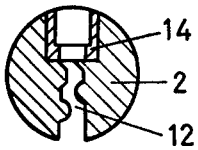
FIG. 6 is a view, in cross section through a cylinder plug showing a slider for the plug pins.

FIG. 6 shows the cylinder plug 2 for a lock cylinder with a single row of pin tumblers. This cylinder plug 2 is likewise equipped with a slider 14 for the plug pins, not shown. A cylinder plug of this kind can also be equipped with a plurality of sliders 14.

The safety locks described above makes it possible for both the cylinder housing 1 and the cylinder plug 2 to be kept in finished form in stock. The sliders 5 and 14 with their various bore patterns can then be installed as desired.

If a cylinder housing 1 according to FIGS. 1 and 2 is to be provided with only one or two rows of pins, inserts 15 (FIG. 4) without bores may be inserted in the longitudinal channels, such as 3*c*, which are not to be used.

As mentioned above, embodiments, in which the cylinder plug 2 is likewise equipped with sliders and associated plug pins, makes it possible to have extremely efficient manufacturing techniques for lock cylinders, since only the sliders 5 and 14 need to be installed in the individual lock cylinders with different bore patterns, while the other parts of the lock always have the same form and may be kept in stock.

There is another possibility for making the manufacturing of the lock cylinder of the present invention still more efficient, especially in the manufacturing of lock systems.

A lock system is a plurality of locks or lock cylinders arranged in a predetermined combination, whose keys are the carries of a programmed ordering function. Such lock systems include keys which fit all locks, while other keys open only a certain group of locks or only a single lock.

Lock systems can be organized by eliminating pin tumblers in certain positions, which must be determined by tedious calculation. The assembly of such a lock cylinder is very costly. Previously, in the case of cylinders with bores for pin tumblers, when individual bores were eliminated, each individual pin and matching pin had to be installed separately. In order to be able to use the prefabricated sliders 5 provided with the housing pins 8 in corresponding housings 1 for lock systems as well, the cylinder plugs 2 as shown in FIG. 1 must be installed in which the individual pin bores 9 are eliminated according to the calculated functions, in other words the bores are not drilled. The corresponding housing pins 8 are consequently ineffective.

In order to prevent the cylinder plug 2 from having to be provided with the necessary pin bores before assembly, it is advantageous to provide the cylinder plug 2 with all the pin bores 9 during manufacture and to cover those of the pin bores 9 not required with blind pins during assembly. Such blind pins block the selected pin bore 9 firmly at the surface of the plug 2 and do not have any points on the inside, so that they cannot project into the passage of the lock 12. In this manner it is possible to keep the drilled cylindrical plugs 2 in stock and modify them for the desired functions by simply installing blind pins when they are assembled.

It is to be understood that the foregoing description of the preferred embodiments has been set forth by way of example, not by way of limitation. Other embodiments and variants are possible without departing from the spirit and scope of the invention, its scope being defined by the appended claims.

What is claimed is:

1. In a lock cylinder for a security lock having a cylinder housing and a cylinder plug provided with tumblers made in the form of plug pins and housing pins arranged in rows, the tumblers being aligned by a key which is to be inserted into the lock, each row of housing pins being mounted with associated pin springs in a respective separate chamber, the respective chambers being installed in respective recesses in the cylinder housing, the improvement wherein said cylindrical housing is provided with longitudinal channels, said separate chambers are defined by respective sliders inserted in an axial direction in respective ones of said longitudinal channels of said cylinder housing; and including bores in said cylinder housing, said housing pins being positioned in said bores; spring means positioned between said cylindrical housing and respective ones of said housing pins, said sliders being mounted with axial play in said longitudinal channels;

at least one plug pin and housing pin pair provided as centering members and which contact one another on their frontal surfaces, a projection in the shape of a section of a cone or sphere being provided on one of said frontal surfaces and a corresponding depression on the other said frontal surface meshing with one another when said cylinder plug is in its locked and open position.

2. An improved lock cylinder according to claim 1, wherein said section of a cone is on an end of said plug pin and said corresponding depression is on an end of said paired housing pin.

3. An improved lock cylinder according to claim 1, wherein said section of a cone is on an end of said paired housing pin and said corresponding depression is on an end of said plug pin.

4. An improved lock cylinder according to claim 1, including at least one plug, pin and a paired housing pin provided at their ends which come in contact with one another with a projection in thw shape of a section of a sphere and a corresponding depression, said plug pin and said pair housing pin meshing with one another when said cylinder plug is in the locked and open position.

5. An improved lock cylinder according to claim 4, wherein said section of a sphere is on an end of said plug pin and said corresponding depression is on an end of said paired housing pin.

6. An improved lock cylinder according to claim 4, wherein said section of a sphere is on an end of said paired housing pin and said corresponding depression is on an end of said plug pin.

7. An improved lock cylinder according to claim 1, wherein at least one of said longitudinal channels of said cylinder housing is closed by an insert having no bores.

8. An improved lock cylinder according to claim 1, including spring means for pressing said sliders radially against said cylinder plug.

9. An improved lock cylinder according to claim 8, wherein said spring means comprise bent leaf springs, said springs abutting respective bottoms of said longitudinal channels and a surface of respective ones of said sliders.

* * * * *